US007712452B2

(12) United States Patent
Matas et al.

(10) Patent No.: US 7,712,452 B2
(45) Date of Patent: May 11, 2010

(54) FUEL DELIVERY SYSTEM FOR AN AIRCRAFT ENGINE

(75) Inventors: Scott E. Matas, Williamsport, PA (US); Steven J. Bowes, Williamsport, PA (US)

(73) Assignee: Lycoming Engines, a division of Avco Corporation, Williamsport, PA (US)

( * ) Notice: Subject to any disclaimer, the term of this patent is extended or adjusted under 35 U.S.C. 154(b) by 147 days.

(21) Appl. No.: 11/809,681

(22) Filed: Jun. 1, 2007

(65) Prior Publication Data

US 2008/0295804 A1 Dec. 4, 2008

(51) Int. Cl.
*F02M 69/46* (2006.01)

(52) U.S. Cl. ..... 123/456

(58) Field of Classification Search ..... 123/468, 123/469, 447, 456, 436; 244/53 R, 57; 137/883, 137/351; *F02M 69/46*
See application file for complete search history.

(56) References Cited

U.S. PATENT DOCUMENTS

| | | | | |
|---|---|---|---|---|
| 3,930,483 | A | 1/1976 | Blisko et al. | |
| 4,286,563 | A | 9/1981 | Fahim et al. | |
| 4,286,777 | A | 9/1981 | Brown | |
| 4,306,708 | A | 12/1981 | Gassaway et al. | |
| 5,044,338 | A * | 9/1991 | Shelton | 123/469 |
| 5,070,844 | A | 12/1991 | Daly | |
| 5,682,857 | A | 11/1997 | Briggs et al. | |
| 6,178,950 | B1 | 1/2001 | Stockner et al. | |
| 6,213,096 | B1 | 4/2001 | Kato et al. | |
| 6,340,019 | B1 | 1/2002 | Eshleman et al. | |
| 6,408,827 | B1 | 6/2002 | Scollard et al. | |
| 6,513,499 | B2 | 2/2003 | Kehoe | |
| 6,604,512 | B2 | 8/2003 | Kato | |
| 6,912,996 | B2 | 7/2005 | Kato | |
| 7,004,146 | B1 | 2/2006 | Kato | |
| 7,263,975 | B2 | 9/2007 | Stieler et al. | |

(Continued)

FOREIGN PATENT DOCUMENTS

DE 19953942 A1 7/2000

(Continued)

OTHER PUBLICATIONS

International Search Report from PCT/US2008/058617, mailed on Oct. 13, 2008.

(Continued)

*Primary Examiner*—Stephen K Cronin
*Assistant Examiner*—Keith Coleman
(74) *Attorney, Agent, or Firm*—BainwoodHuang

(57) ABSTRACT

An engine includes a fuel delivery system having a fuel rail and fuel delivery devices, such as fuel injectors, that deliver fuel to corresponding cylinder assemblies. The use of the fuel rail and fuel injectors allows unused fuel to be purged from the engine at the end of the engine's operating cycle, thereby minimizing the creation of fuel vapor within the engine. The fuel delivery system also includes fuel rail coupling members that are constructed and arranged to secure each cylinder assembly to the fuel rail and to absorb load generated by the corresponding cylinder assembly on the fuel rail during operation. The fuel rail coupling members allow motion of the cylinder assemblies relative to the fuel rail during operation and minimize the application of potentially damaging forces on the fuel rail.

24 Claims, 6 Drawing Sheets

U.S. PATENT DOCUMENTS

| | | | | |
|---|---|---|---|---|
| 2001/0010217 | A1 | 8/2001 | Sato et al. | |
| 2005/0126538 | A1* | 6/2005 | Warne et al. | 123/436 |
| 2006/0214054 | A1* | 9/2006 | Fuerlinger et al. | 244/53 R |
| 2007/0163545 | A1 | 7/2007 | Beardmore et al. | |
| 2008/0027620 | A1* | 1/2008 | Feuerlinger et al. | 701/101 |

FOREIGN PATENT DOCUMENTS

| | | | |
|---|---|---|---|
| EP | 0725208 | | 8/1996 |
| EP | 0994249 | A | 4/2000 |
| EP | 1150002 | A | 10/2001 |
| EP | 1637729 | A | 3/2006 |
| FR | 2874060 | A | 2/2006 |

OTHER PUBLICATIONS

Written Opinion from PCT/US2008/058617, mailed on Oct. 13, 2008.

* cited by examiner

FUEL DELIVERY SYSTEM FOR AN AIRCRAFT ENGINE

BACKGROUND

Conventional reciprocating aircraft engines include multiple cylinder head assemblies used to drive a crankshaft. During operation, in order to drive the crankshaft each cylinder head assembly requires fuel, such as provided by a fuel pump. For example, as illustrated in FIGS. 1A and 1B, a conventional aircraft engine 10 includes separate cylinder assemblies, collectively referred to as 12, and a fuel distribution assembly 14 that provides fuel to each cylinder assembly 12 from the fuel pump (not shown). As illustrated, the fuel distribution assembly 14 includes a hub 16, connector tubes 18, and fuel nozzles 20 where each connector tube 18 and fuel nozzle 20 connects the hub 16 to a corresponding cylinder assembly 12. In use, the hub 16 receives fuel from the fuel pump and distributes the fuel to each cylinder assembly 12 through each corresponding connector tube 18 and fuel nozzle 20.

During operation, as a piston (not shown) reciprocates within each cylinder assembly 12, the piston generates a force within the cylinder assembly 12 sufficient to cause relative motion of the cylinder assembly 12. For example, as a piston within a cylinder assembly 12-1 fires, the loads generated by the piston on the crankshaft causes the cylinder assembly 12-1 to generate a load on the crankcase 22 which carries the cylinder assemblies 12. This load causes the crankcase 22 to bend or flex such that the operational cylinder assembly 12-1 moves relative to the then non-operational cylinder assemblies 12-2, 12-3. To prevent damage to the fuel distribution assembly 14 as caused by the relative motion of the cylinder assemblies, the connector tubes 18 of the fuel delivery assembly are formed of a generally flexible material. As a result, during operation of the aircraft engine 10, as each cylinder assembly 12-1, 12-2, 12-3 moves relative to each other, the connector tubes 18 absorb the motion of the cylinder assemblies 12-1, 12-2, 12-3 relative to the hub 16. Accordingly, the flexibility of the connector tubes 18 helps to prevent the development and propagation of fractures within the fuel delivery system during operation.

SUMMARY

Conventional fuel delivery systems for aircraft engines can suffer from certain deficiencies. For example, while the fuel distribution assembly 14 provides fuel to each cylinder assembly 12 from the fuel pump during operation, the fuel distribution assembly 14 cannot purge the fuel contained within the connector tubes 18 at the conclusion of operation of the engine 10. Accordingly, once the engine 10 is turned off, a portion of the fuel contained within the connector tubes 18 drains into the cylinder assemblies 12 through corresponding nozzles 20. In this post-operational state, the cylinder assemblies 12 absorb heat from the engine components which, in turn, vaporizes the fuel contained in the cylinder assemblies 12 and connector tubes 18. Vaporization of the fuel within the fuel distribution assembly 14 can disrupt the operation of the fuel pump during a subsequent operation of the engine.

Embodiments of the present invention provide a fuel delivery system that allows fuel to be purged from an engine following engine operation and that allows for relative motion of the cylinder assemblies during operation while minimizing the application of excessive loads on the fuel delivery system. The engine includes a fuel delivery system having a fuel rail and fuel delivery devices, such as fuel injectors, that deliver fuel to corresponding cylinder assemblies. The use of the fuel rail and fuel injectors allows unused fuel to be purged from the engine at the end of the engine's operating cycle, thereby minimizing the creation of fuel vapor within the engine. The fuel delivery system also includes fuel rail coupling members that are constructed and arranged to secure each cylinder assembly to the fuel rail and to absorb at least a portion of a load generated by the corresponding cylinder assembly on the fuel rail during operation. The fuel rail coupling members allow motion of the cylinder assemblies relative to the fuel rail during operation and minimize the application of potentially damaging forces on the fuel rail.

In one arrangement, a fuel delivery system for an aircraft engine includes a fuel rail, a set of fuel delivery devices, and a set of fuel rail coupling members. The fuel rail includes a set of fuel delivery ports disposed between a fuel inlet and a fuel outlet of the fuel rail. Each fuel delivery device of the set of fuel delivery devices is disposed between each fuel delivery port of the set of fuel delivery ports and a corresponding cylinder assembly of the aircraft engine. Each fuel delivery device is configured to provide fuel from the fuel rail to the corresponding cylinder assembly. Each fuel rail coupling member of the set of fuel rail coupling members is constructed and arranged to secure a corresponding cylinder assembly to the fuel rail and to absorb a load generated by the corresponding cylinder assembly on the fuel rail.

In one arrangement, a fuel delivery system for an aircraft engine includes a crankcase assembly, a set of cylinder assemblies, and a fuel delivery system. The crankcase assembly includes a crankcase housing and a crankshaft disposed within the crankcase housing. Each cylinder assembly of the a set of cylinder assemblies having a cylinder housing, a piston, and a connecting rod, the piston and connecting rod being disposed within the cylinder housing, the piston coupled to the connecting rod and the connecting rod coupled to the crankshaft. The fuel delivery system includes a fuel rail, a set of fuel delivery devices, and a set of fuel rail coupling members. The fuel rail includes a set of fuel delivery ports disposed between a fuel inlet and a fuel outlet of the fuel rail. Each fuel delivery device of the set of fuel delivery devices is disposed between each fuel delivery port of the set of fuel delivery ports and a corresponding cylinder assembly of the set of cylinder assemblies. Each fuel delivery device is configured to provide fuel from the fuel rail to the corresponding cylinder assembly. Each fuel rail coupling member of the set of fuel rail coupling members is constructed and arranged to secure a corresponding cylinder assembly to the fuel rail and to absorb a load generated by the corresponding cylinder assembly on the fuel rail as the piston and connecting rod reciprocate within the cylinder housing.

In one arrangement, a method for assembling a fuel delivery system of an aircraft engine includes disposing a fuel rail within the aircraft engine, the fuel rail having a set of fuel delivery ports disposed between a fuel inlet and a fuel outlet of the fuel rail. The method includes securing the fuel rail to a set of cylinder assemblies using a set of fuel rail coupling members, each fuel rail coupling member of the set of fuel rail coupling members securing a corresponding cylinder assembly to the fuel rail, each fuel rail coupling member constructed and arranged to absorb a load generated by the corresponding cylinder assembly on the fuel rail. The method includes disposing a set of fuel delivery devices between each fuel delivery port of the set of fuel delivery ports and the corresponding cylinder assembly of the aircraft engine, each fuel delivery device configured to provide fuel from the fuel rail to the corresponding cylinder assembly.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the present invention provide a fuel delivery system for an engine that allows fuel to be purged from the engine following engine operation and that minimizes the ability for the engine to place excessive loads on the fuel delivery system. The engine includes a fuel delivery system having a fuel rail and fuel delivery devices, such as fuel injectors, that deliver fuel to corresponding cylinder assemblies. The use of the fuel rail and fuel injectors allows unused fuel to be purged from the engine at the end of the engine's operating cycle, thereby minimizing the creation of fuel vapor within the engine. The fuel delivery system also includes fuel rail coupling members that are constructed and arranged to secure each cylinder assembly to the fuel rail and to absorb load generated by the corresponding cylinder assembly on the fuel rail during operation. The fuel rail coupling members allow motion of the cylinder assemblies relative to the fuel rail during operation and minimize the application of potentially damaging forces on the fuel rail.

Figure 1A:
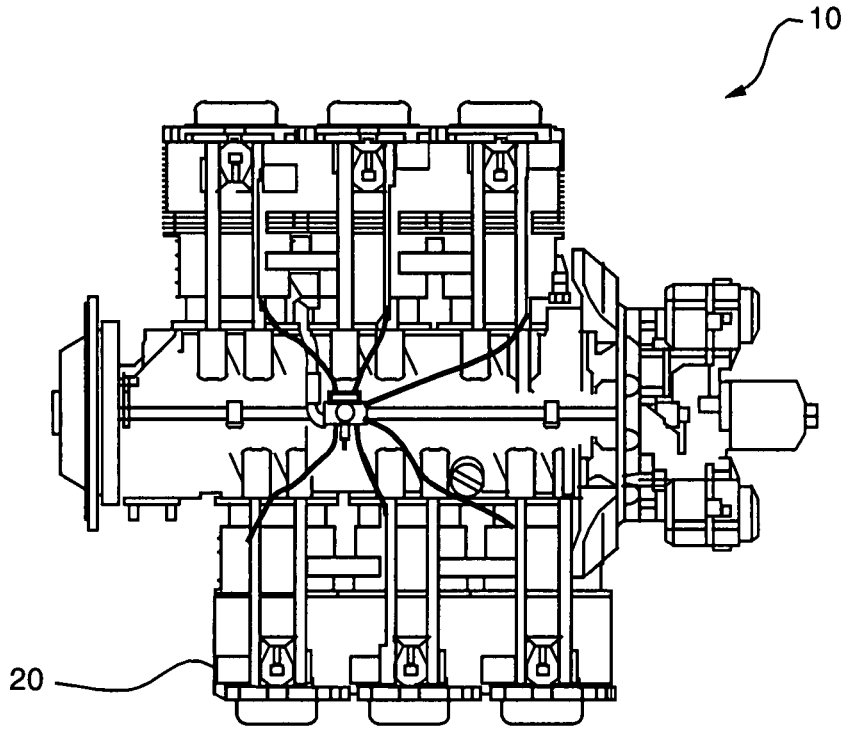
FIG. 1A (PRIOR ART)
FIG. 1A illustrates a top view of a prior art engine.
Figure 1B:
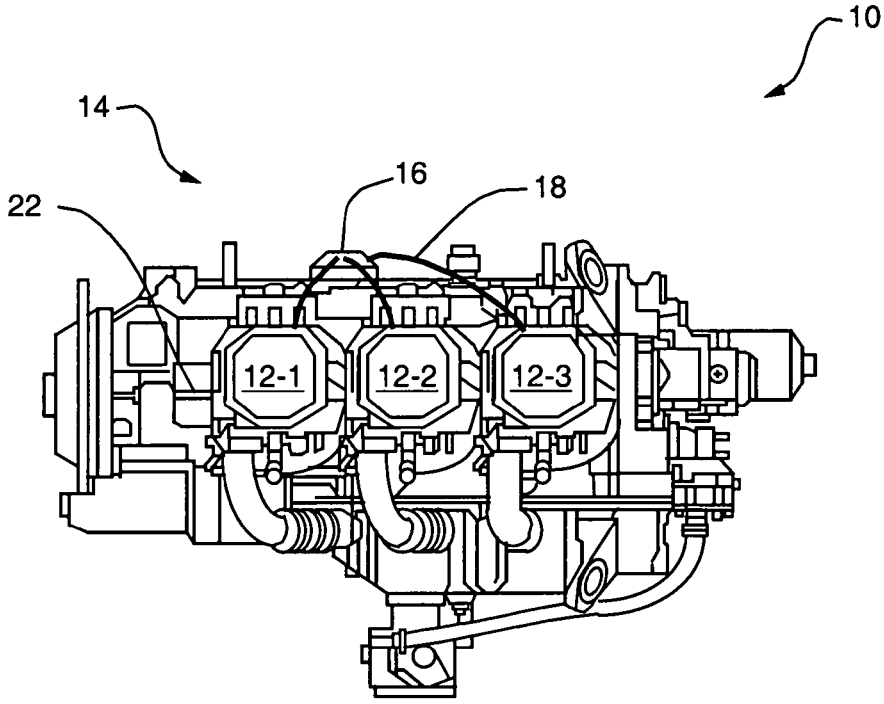
FIG. 1B (PRIOR ART)
FIG. 1B illustrates a side view of the prior art engine of FIG. 1A.
Figure 2:
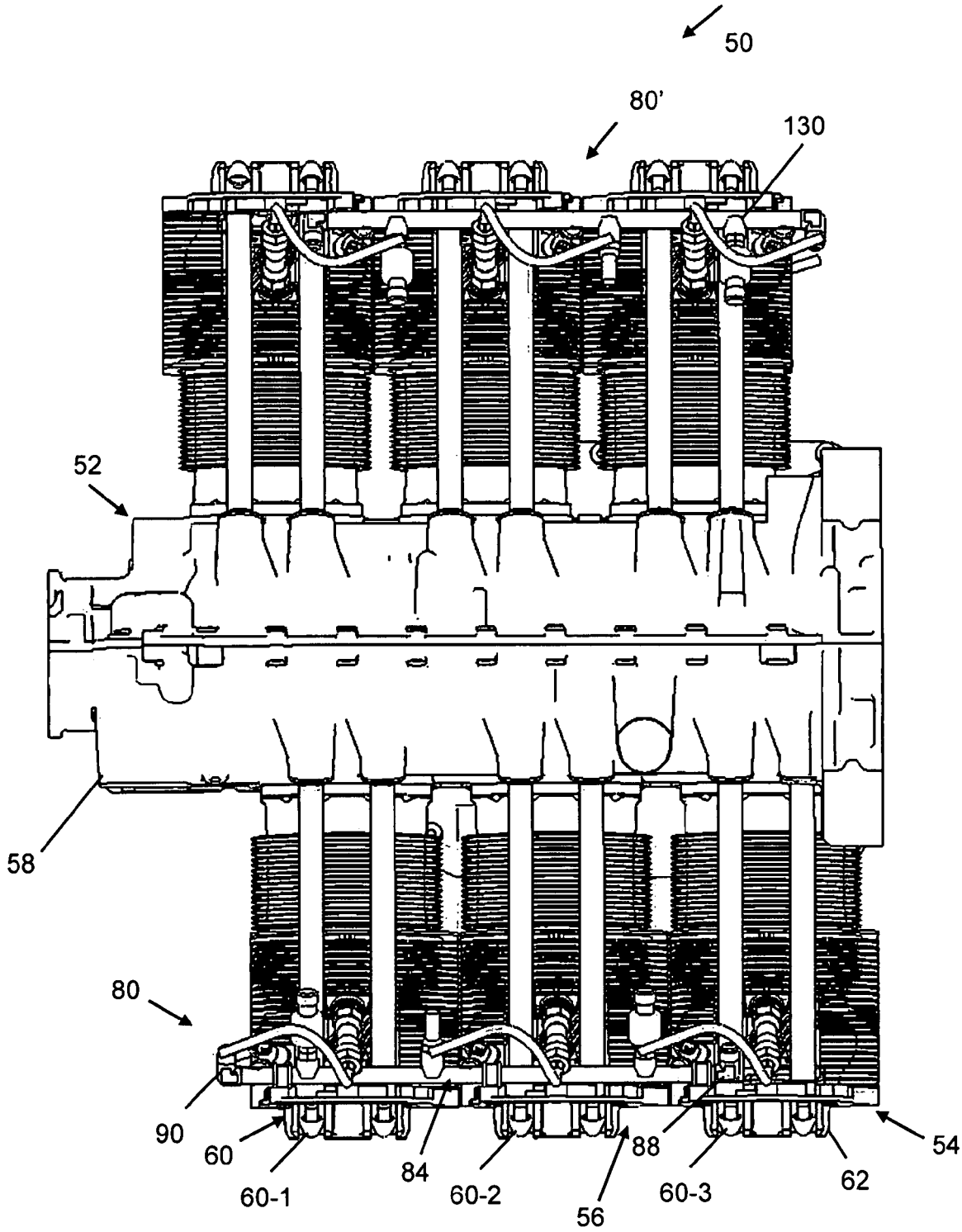
FIG. 2 illustrates a top view of an engine having a fuel delivery system, according to one embodiment of the invention.
Figure 3:
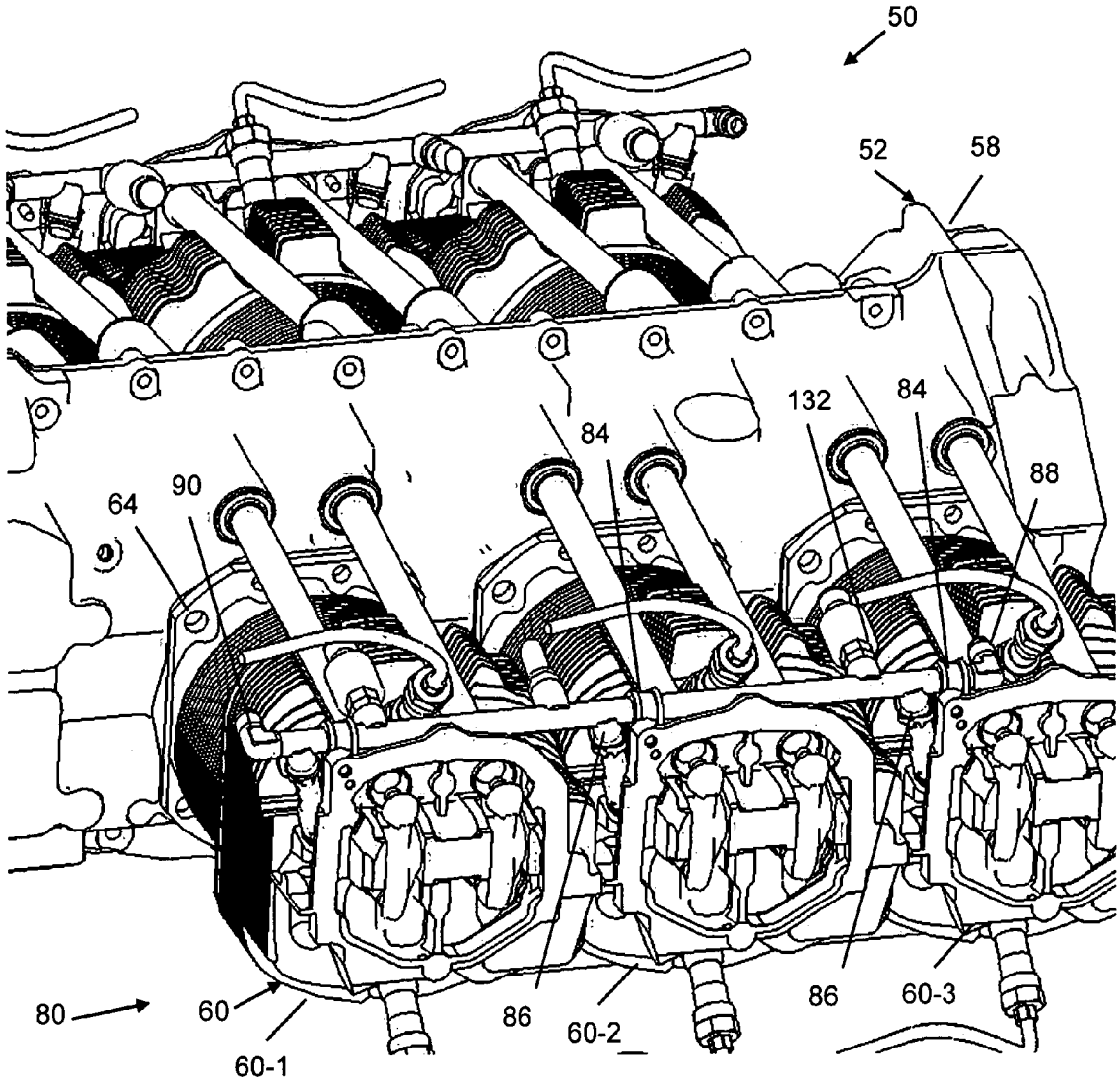
FIG. 3 illustrates a top perspective view of the engine of FIG. 2.

FIGS. 2-6 illustrate an arrangement of an engine 50, such as an aircraft engine, having a crankcase assembly 52, a set of cylinder assemblies 54, and a fuel delivery system 56. The crankcase assembly 52 includes a crankcase housing 58 and a crankshaft (not shown) disposed within the crankcase housing 58. Each cylinder assembly 60 of the set of cylinder assemblies 54 includes a cylinder housing 62 secured to the crankcase housing 58 of the engine 50. For example, as indicated in FIG. 3, each cylinder assembly 60 couples to the crankcase housing 58 by fasteners that are inserted through a series of openings 64 defined by the cylinder assembly 60 and secured to the crankcase housing 58.

Figure 4:
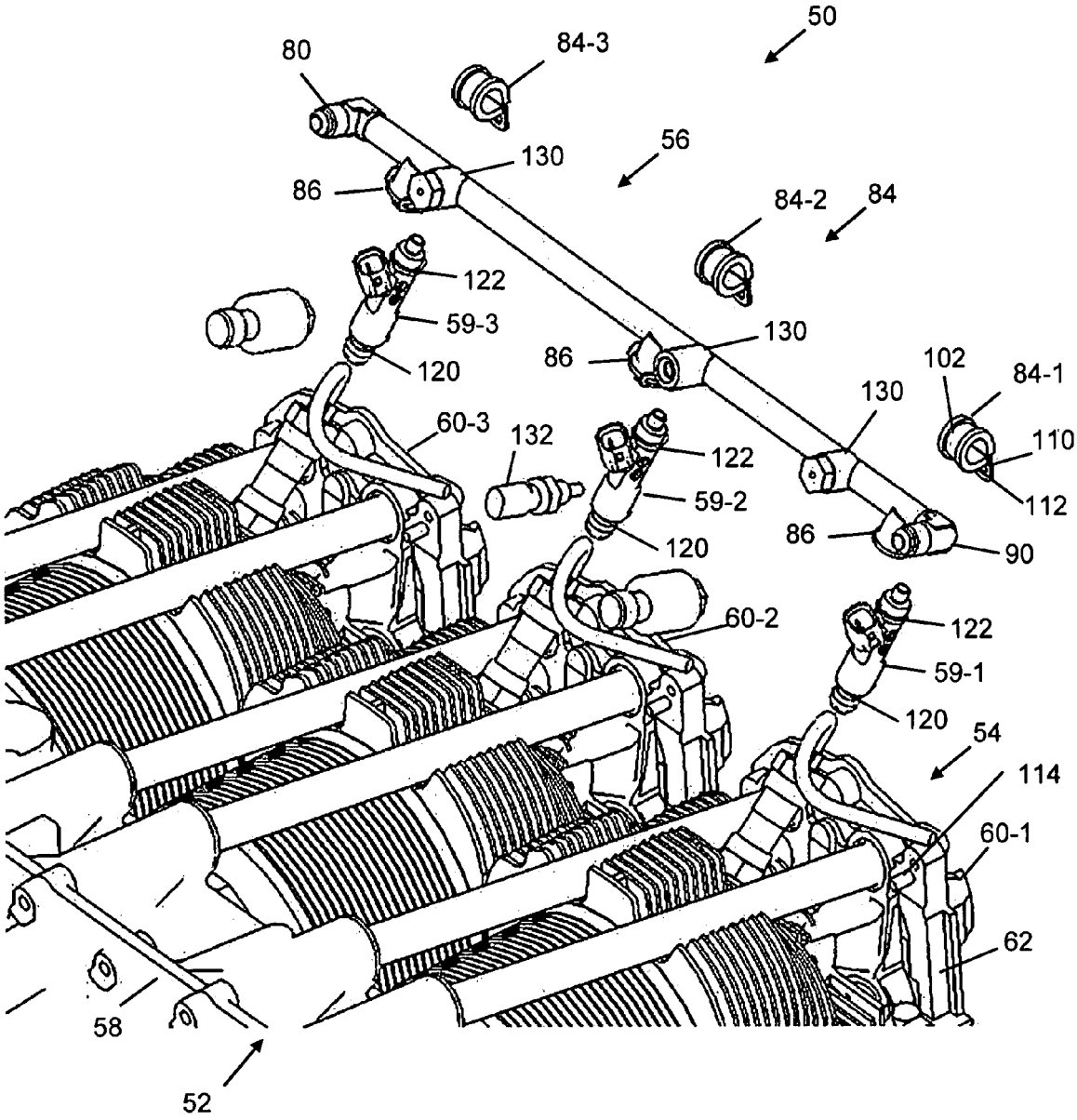
FIG. 4 illustrates a perspective exploded view of the fuel delivery system of FIG. 2.
Figure 5:
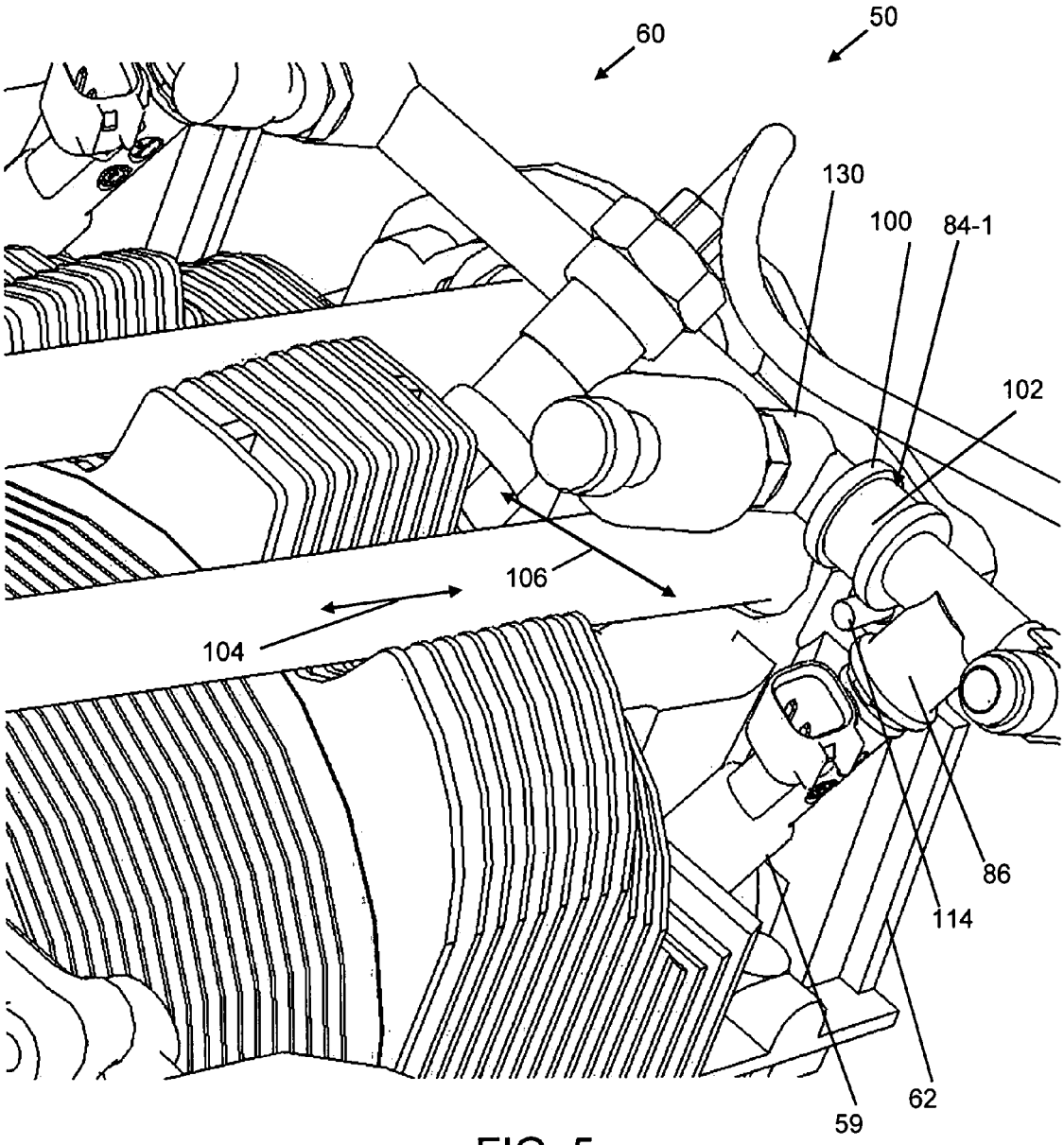
FIG. 5 illustrates a fuel rail coupling member of the fuel delivery system of FIG. 2, which secures a fuel rail to a corresponding cylinder assembly of the engine.
Figure 6:
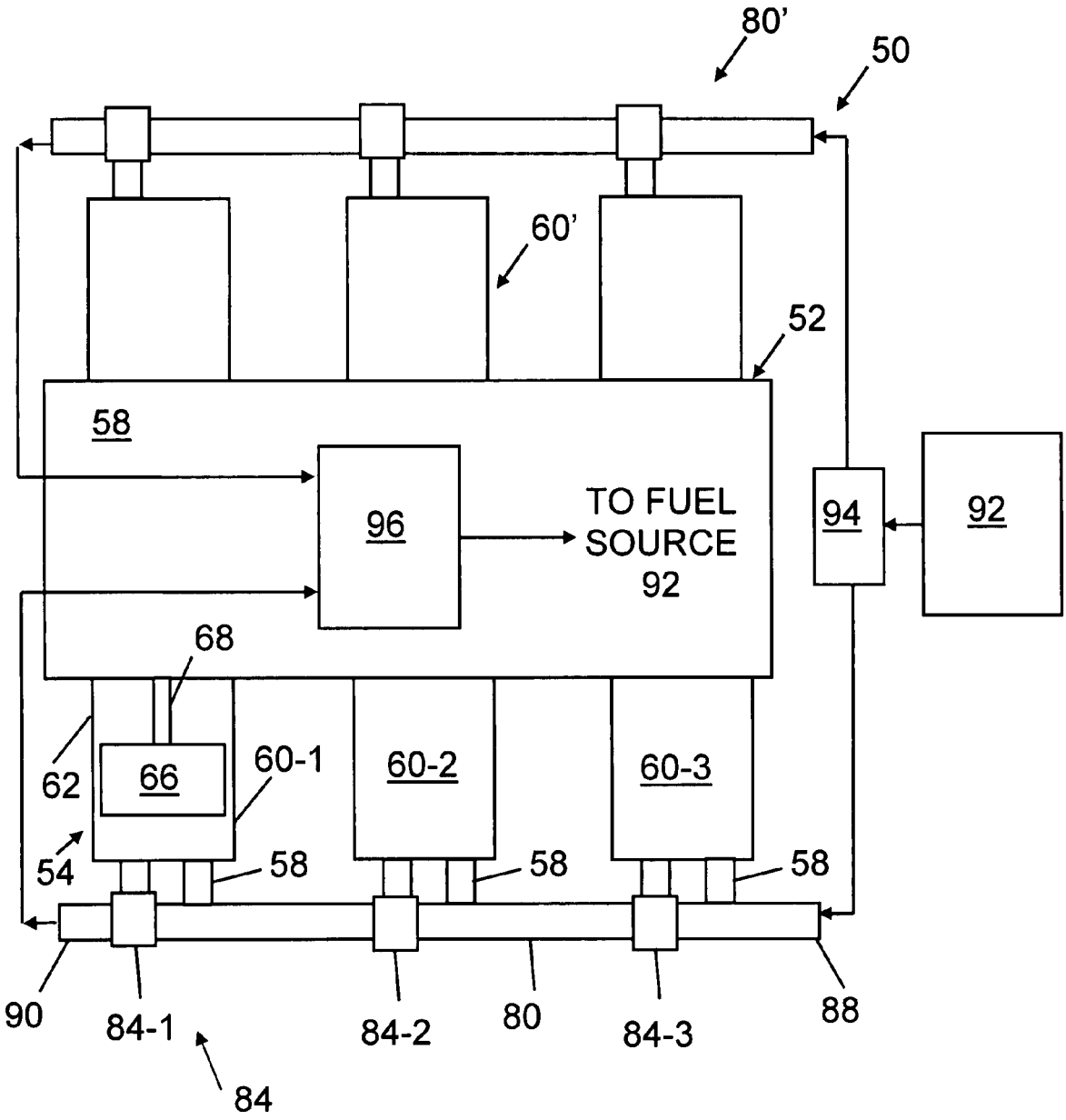
FIG. 6 illustrates a schematic overhead view of the fuel delivery system of FIG. 2.

Each cylinder assembly 60, as indicated in a cut-away view of a cylinder assembly in FIG. 6, includes a piston 66 and a connecting rod 68 disposed within the cylinder housing 62. The connecting rod 68 connects to both the piston 66 and the crankshaft (not shown) carried by the crankcase assembly 52. The piston 66 and connecting rod 68 are configured to reciprocate within the cylinder housing 62 to drive or rotate the crankshaft. While the engine 50 can have any number of cylinder assemblies, in one arrangement, as indicated in FIGS. 2-6, the engine includes six cylinder assemblies 60, with three cylinder assemblies 60 being mounted to either side of the crankcase housing 58.

The fuel delivery system 56 is configured to provide fuel from a fuel source to each of the cylinder assemblies 60. In one arrangement, the fuel delivery system 56 includes a fuel rail 80, a set of fuel delivery devices 59, and a set of fuel rail coupling members 84. The fuel rail 80 is configured as a generally tubular structure having a set of fuel delivery ports 86 disposed between a fuel inlet 88 and a fuel outlet 90. In one arrangement, as particularly illustrated in FIG. 6, the fuel inlet 88 is fluid communication with a fuel source or tank 92 by way of a fuel pump 94. The fuel pump 94 is configured to withdraw fuel from the fuel source 92 and deliver the fuel under pressure to the fuel inlet 88 of the fuel rail 80. Also in the arrangement shown, the fuel outlet 90 is in fluid communication with the fuel source 92 by way of a fuel pressure regulator 96. The fuel pressure regulator 96 is configured to receive, from the fuel outlet 90, unused fuel carried by the fuel rail 80 and deliver the unused fuel to the fuel source 92. The combination of the fuel rail 80 with the fuel pump 94, fuel pressure regulator 96 and the fuel source 92 forms a fluid circuit.

As indicated in FIG. 2, the engine includes two separate fuel rails 80, 80', one fuel rail 80 configured to carry fuel to cylinder assemblies 60 disposed on a first side of the crankcase housing 58 and a second fuel rail 80' configured to carry fuel to cylinder assemblies disposed on a second, opposing side of the crankcase housing 58. For convenience, the following description will focus on a single fuel rail 80 associated with the engine 50.

In one arrangement, with particular reference to FIGS. 2 and 3, the fuel rail 80 is disposed along a length of the engine 50 as defined by serially-located cylinder assemblies 60. For example, as illustrated, the fuel rail 80 extends along the head portions of the first, second, and third cylinder assemblies 60-1 through 60-3. The fuel rail 80 is positioned relative to the engine 50 in this manner to minimize interference with the engine's operation (e.g., operation of the cylinder assemblies or cooling of the engine 50).

The fuel rail 80 provides fuel to the cylinder assemblies via fuel delivery devices 59. Each fuel delivery device of the set of fuel delivery devices 59 is configured to divert a portion of the fuel flowing through the fuel rail 80 into a corresponding cylinder assembly 60. For example, as indicated in FIG. 4, each of the cylinder assemblies 60-1 through 60-3 includes its own corresponding fuel delivery device 59-1 through 59-3. During operation, as a volume of fuel flows from the inlet port 88 toward the exit port 90, the first fuel delivery device 59-1 provides a portion of the fuel volume to the first cylinder assembly 60-1, the second fuel delivery device 59-1 provides a portion of the fuel volume to the second cylinder assembly 60-2, and the third fuel delivery device 59-3 provides a portion of the fuel volume to the third cylinder assembly 60-3. While each fuel delivery device 59 can be configured in a variety of ways, in one arrangement, the fuel delivery device 59 is configured as a fuel injector that atomizes the received fuel and provides the atomized fuel to the corresponding cylinder assembly 60.

The set of fuel rail coupling members 84 are configured to secure the fuel rail 80 to the set of cylinder assemblies 54. The set of fuel rail coupling members 84 are also constructed and arranged to absorb loads generated by the corresponding cylinder assembly 60 relative to the fuel rail 80 during operation. For example, to fuel rail coupling members 84 allow the cylinder assemblies 60 in the set of cylinder assemblies 54 to move relative to each other while minimizing the load that each cylinder assembly 60 places on the fuel rail 80 during operation. Accordingly, the fuel rail coupling members 84 secure the fuel rail 80 to the engine 50 while minimizing potential damage to the fuel rail 80 as caused by operation of the engine 50.

As illustrated in the embodiment shown FIGS. 2-6, the number of fuel rail coupling members 84 corresponds to the number of cylinder assemblies 60 disposed on either the first or second side of the crankcase housing 58. For example, with particular reference to FIG. 4, the engine 50 includes, on one side of the crankcase housing 58, three cylinder assemblies 60-1 through 60-3. To secure the fuel rail 80 to the engine 50, three fuel rail coupling members 84 are used: a first fuel rail coupling member 84-1 that secures the fuel rail 80 to the first cylinder assembly 60-1, a second fuel rail coupling member 84-2 that secures the fuel rail 80 to the second cylinder assembly 60-2, and a third fuel rail coupling member 84-1 that secures the fuel rail 80 to the third cylinder assembly 60-1.

While the fuel rail coupling members 84 can be configured in a variety of ways, in one arrangement and with particular reference to the fuel rail coupling member 84-1 of FIGS. 4 and 5, the fuel rail coupling member 84-1 includes a compliant support 100 and a bracket 102. The bracket 102 is configured to secure the compliant support 100 to the fuel rail 80 and to secure the fuel rail 80 to the cylinder assembly 60-1. The compliant support 100, in one arrangement, is configured to yield elastically upon application of a force thereto to absorb at least a portion of a load generated by the cylinder assembly 60-1 on the fuel rail 80 during operation. For example, while the compliant support can be formed from a variety of materials, in one arrangement, the compliant support 100 formed of a rubber material that compresses in response to application of a compressive loading. Accordingly, the compressive properties of the compliant support 100 allow for dissipation of at least a portion of the load generated by the cylinder assembly 60-1 on the fuel rail 80.

In use, and with particular attention to FIG. 6, each cylinder assembly 60 receives fuel from the corresponding fuel delivery device 59. The fuel explodes within each cylinder assembly housing 62 and causes the piston 66 and a connecting rod 68 to reciprocate within the cylinder assembly housing 62. Forces generated by cylinder assemblies 60 on the crankshaft (not shown) disposed within the crankcase housing 58 causes the crankcase housing 58 to flex or bend, such as at the location of cylinder assemblies 60. Accordingly, such flexure causes each cylinder assembly 60 and attached bracket 102 to move relative to the fuel rail 80.

With particular reference to cylinder assembly 60-1, as the cylinder assembly 60-1 moves along a substantially vertical direction 104, along a substantially horizontal direction 106, or along some combination of the two directions 104, 106, the cylinder assembly 60-1 moves the bracket 102 relative to the fuel rail 80. Accordingly, because the compliant support 100 is disposed between the fuel rail 80 and the bracket 102, the compliant support 100 becomes compressed in response to such loading. This compression helps to absorb a least a portion of the load generated by the cylinder assembly 60-1 on the fuel rail 80, thereby minimizing excessive loading on and potential damage to the fuel rail 80.

At the conclusion of the engine's operation, because the engine 50 is configured with the fuel delivery system 56 as described above, a user can drain fuel from the engine to minimize vaporization of the fuel within the engine 50. For example, while the engine 80 is hot after operation, the fuel pressure regulator 96 receives unused fuel from the cylinder assemblies 60 and from the fuel rail 80 via fuel outlet 90 and delivers the unused fuel to the fuel source 92. Accordingly, because the fuel delivery system 56 allows fuel to be purged from the engine 50 after engine operation, the fuel delivery system 56 minimizes the ability for portions of the engine 50 to become disrupted by fuel vaporization.

While various embodiments of the invention have been particularly shown and described, it will be understood by those skilled in the art that various changes in form and details may be made therein without departing from the spirit and scope of the invention as defined by the appended claims.

For example, as indicated above, each bracket 102 of the fuel rail coupling members 84 is configured to secure a corresponding compliant support 100 to the fuel rail 80 and to secure the fuel rail 80 to a corresponding cylinder assembly. In one arrangement, each bracket 102 is moveably coupled a corresponding cylinder assembly 60. In one arrangement, with particular reference to FIGS. 4 and 5, each bracket 102 includes a bracket portion 110 that defines an aperture 112. The aperture 112 is sized and shaped to receive a protrusion 114, such as a post, extending from a corresponding cylinder assembly, such as shown with respect to cylinder assembly 60-1. The diameter of the aperture 112 is larger than an outer diameter of the protrusion 114. In this configuration, when the protrusion 114 extends into the aperture 112, the bracket 102 secures the fuel rail 80 to the cylinder assembly 60-1 while allowing both vertical 104 and longitudinal 108 motion of the fuel rail 80 relative to the cylinder assembly 60-1. Such motion can be caused, for example, when operation of other cylinder assemblies 60-2, 60-3 within the set of cylinder assemblies causes the fuel rail 80 to move within the engine 50.

For example, assume that during operation, the second cylinder assembly 60-2 fires and generates a horizontal and vertical load on the fuel rail 80. The compliant support 102 of the coupling member 84-2 absorbs at least some of the vertical and longitudinal forces generated by the cylinder assembly 60-2 on the fuel rail 80. However, generally longitudinal motion of the cylinder assembly 60-2 can cause the fuel rail 80 to translate along the longitudinal direction 106 relative to adjacent cylinder assemblies 60-1, 60-3. Because the diameter of the aperture 112 for each coupling member 84-1, 84-3 is larger than an outer diameter of the protrusion 114 for each adjacent cylinder assembly 60-1, 60-3, substantially longitudinal translation of the fuel rail 80 causes the brackets 102 to translate relative to the protrusions 114 of each cylinder assembly 60-1, 60-3. Accordingly, the configuration of the brackets minimizes loading of the fuel rail 80 at any of the locations of the coupling member 84-1, 84-3 as caused by longitudinal translation of the fuel rail 80 within the engine 50.

As indicated above, the fuel rail coupling members 84 include compliant supports configured to absorb at least a portion of the lateral and vertical loads applied to the fuel rail 80 by a corresponding cylinder assembly 60. In one arrangement, the fuel delivery devices 59 also operate to absorb these lateral and vertical loads. For example, with particular attention to FIG. 4, each fuel delivery device 59, such as a fuel injector, includes compliant members 120, 122 disposed at opposing ends. As illustrated, the fuel injectors include a first compliant member 120, such as one or more O-rings, disposed at a cylinder assembly coupling end of the fuel injector 54 and a second compliant member 122, such as one or more O-rings disposed at a fuel rail coupling end of the fuel injector 54. The first and second compliant members 120, 122 act to seal a fluid pathway between the fuel rail 80 and the corresponding cylinder assembly 60. For example, the cylinder assembly coupling end of the fuel injector 54 is disposed within a corresponding port of the cylinder assembly 60 such that interaction between the cylinder assembly port and the cylinder assembly coupling end of the fuel injector 54 compresses the first compliant member 120 to seal the fuel injector 54 relative to the cylinder assembly 60. Also, the fuel rail coupling end of the fuel injector 54 is disposed within a corresponding fuel delivery port 86 such that interaction between the fuel delivery port 86 and the fuel rail coupling end of the fuel injector 54 compresses the second compliant member 122 to seal the fuel injector 54 relative to the fuel rail 80. The first and second compliant members 120, 122 also absorb at least a portion of a load generated by the cylinder assembly 60-1 on the fuel rail 80 during operation.

As indicated above, the fuel rail 80 is configured as a generally tubular structure having a set of fuel delivery ports 86 disposed between a fuel inlet 88 and a fuel outlet 90. In one arrangement, the fuel rail 80 also includes one or more fuel sensor ports 130 each of which configured to carry a corresponding fuel sensor 132, such as a temperature sensor or a pressure sensor. The fuel sensors 132 allow various aspects (i.e., pressure, temperature) of the fuel to be electronically monitored such as by a central controller (not shown). As a result of such monitoring, the controller can adjust various parameters of the engine 50 to minimize fuel consumption and/or maximize operating efficiency of the engine 50.

What is claimed is:

1. A fuel delivery system for an aircraft engine, comprising:

a common fuel rail having a set of fuel delivery ports disposed between a fuel inlet and a fuel outlet of the common fuel rail;

a set of fuel delivery devices, each fuel delivery device of the set of fuel delivery devices being disposed between each fuel delivery port of the set of fuel delivery ports and a corresponding cylinder assembly of the aircraft engine, each fuel delivery device configured to provide fuel from the common fuel rail to the corresponding cylinder assembly; and a set of fuel rail coupling members, each fuel rail coupling member of the set of fuel rail coupling members being constructed and arranged to secure a corresponding cylinder assembly to the common fuel rail and to absorb at least a portion of a load generated by the corresponding cylinder assembly on the common fuel rail.

2. The fuel delivery system of claim 1, wherein each fuel rail coupling member comprises a compliant support, at least a portion of the compliant support being compressed against the common fuel rail by motion of the corresponding cylinder assembly relative to the common fuel rail.

3. The fuel delivery system of claim 2, wherein each fuel rail coupling member comprises a bracket disposed about the compliant support, the bracket being constructed and arranged to moveably couple the common fuel rail to the corresponding cylinder assembly.

4. The fuel delivery system of claim 1, wherein at least one fuel delivery device of the set of fuel delivery devices comprises a first compliant member disposed at a cylinder assembly coupling end of the at least one fuel delivery device and a second compliant member disposed at a fuel rail coupling end of the at least one fuel delivery device, the first compliant member and the second compliant member constructed and arranged to allow motion of the corresponding cylinder assembly relative to the common fuel rail.

5. The fuel delivery system of claim 4, wherein the at least one fuel delivery device comprises a fuel injector.

6. The fuel delivery system of claim 1, wherein the common fuel rail comprises a set of fuel sensor ports, each of the set of fuel sensor ports constructed and arranged to receive a fuel sensor, the set of fuel sensor ports being distinct from the set of fuel delivery ports.

7. The fuel delivery system of claim 6, comprising a temperature sensor carried by at least one fuel sensor port of the set of fuel sensor ports.

8. The fuel delivery system of claim 6, comprising a pressure sensor carried by at least one fuel sensor port of the set of fuel sensor ports.

9. The fuel delivery system of claim 1, comprising a fuel pressure regulator in fluid communication with the fuel outlet of the common fuel rail, the fuel pressure regulator being constructed and arranged to withdraw fuel from the fuel outlet of the common fuel rail and to deliver the withdrawn fuel to a fuel tank.

10. The fuel delivery system of claim 1, comprising a fuel pump in fluid communication with the fuel inlet of the common fuel rail, the fuel pump being constructed and arranged to withdraw fuel from a fuel tank and to deliver the withdrawn fuel to the fuel inlet of the common fuel rail.

11. An aircraft engine, comprising:

a crankcase assembly having a crankcase housing and a crankshaft disposed within the crankcase housing;

a set of cylinder assemblies coupled to the crankcase housing of the crankcase assembly, each cylinder assembly of the a set of cylinder assemblies having a cylinder housing, a piston, and a connecting rod, the piston and connecting rod being disposed within the cylinder housing, the piston coupled to the connecting rod and the connecting rod coupled to the crankshaft; and a fuel delivery system having:

a common fuel rail having a set of fuel delivery ports disposed between a fuel inlet and a fuel outlet of the common fuel rail, a set of fuel delivery devices, each fuel delivery device of the set of fuel delivery devices being disposed between each fuel delivery port of the set of fuel delivery ports and a corresponding cylinder assembly of the set of cylinder assemblies, each fuel delivery device configured to provide fuel from the common fuel rail to the corresponding cylinder assembly; and a set of fuel rail coupling members, each fuel rail coupling member of the set of fuel rail coupling members being constructed and arranged to secure a corresponding cylinder assembly to the common fuel rail and to absorb at least a portion of a load generated by the corresponding cylinder assembly on the common fuel rail as the piston and connecting rod reciprocate within the cylinder housing.

12. The aircraft engine of claim 11, wherein each fuel rail coupling member comprises a compliant support disposed about an outer circumference of the common fuel rail, at least a portion of the compliant support being compressed against the common fuel rail by motion of the corresponding cylinder assembly relative to the common fuel rail.

13. The aircraft engine of claim 12, wherein each fuel rail coupling member comprises a bracket disposed about the compliant support, the bracket being constructed and arranged to moveably couple the common fuel rail to the corresponding cylinder assembly.

14. The aircraft engine of claim 12, wherein the at least one fuel delivery device of the set of fuel delivery devices comprises a first compliant member disposed at a cylinder assembly coupling end of the at least one fuel delivery device and a second compliant member disposed at a fuel rail coupling end of the at least one fuel delivery device, the first compliant member and the second compliant member constructed and arranged to allow motion of the corresponding cylinder assembly relative to the common fuel rail.

15. The aircraft engine of claim 14, wherein the at least one fuel delivery device comprises a fuel injector.

16. The aircraft engine of claim 11, wherein the common fuel rail comprises a set of fuel sensor ports, each of the set of fuel sensor ports constructed and arranged to receive a fuel sensor, the set of fuel sensor ports being distinct from the set of fuel delivery ports.

17. The aircraft engine of claim 11, comprising a fuel pressure regulator in fluid communication with the fuel outlet of the common fuel rail, the fuel pressure regulator being constructed and arranged to withdraw fuel from the fuel outlet of the common fuel rail and to deliver the withdrawn fuel to a fuel tank.

18. The aircraft engine of claim 11, comprising a fuel pump in fluid communication with the fuel inlet of the common fuel rail, the fuel pump being constructed and arranged to withdraw fuel from a fuel tank and to deliver the withdrawn fuel to the fuel inlet of the common fuel rail.

19. The aircraft engine of claim 11, wherein the common fuel rail is disposed in proximity to each cover portion of each cylinder assembly of the set of cylinder assemblies, each cover portion opposing a corresponding attachment portion of each cylinder assembly, the common fuel rail extending along a length defined by serially-located cover portion of the set of cylinder assemblies.

20. A method for assembling a fuel delivery system of an aircraft engine, comprising:

disposing a common fuel rail within the aircraft engine, the common fuel rail having a set of fuel delivery ports disposed between a fuel inlet and a fuel outlet of the common fuel rail;

securing the common fuel rail to a set of cylinder assemblies using a set of fuel rail coupling members, each fuel rail coupling member of the set of fuel rail coupling members securing a corresponding cylinder assembly to the common fuel rail, each fuel rail coupling member constructed and arranged to absorb a load generated by the corresponding cylinder assembly on the common fuel rail; and disposing a set of fuel delivery devices between each fuel delivery port of the set of fuel delivery ports and the corresponding cylinder assembly of the aircraft engine, each fuel delivery device configured to provide fuel from the common fuel rail to the corresponding cylinder assembly.

21. A fuel delivery system for an aircraft engine, comprising:

a common fuel rail having a set of fuel delivery ports disposed between a fuel inlet and a fuel outlet of the common fuel rail, each fuel delivery port of the set of fuel delivery ports being constructed and arranged to provide fuel from the common fuel rail to a corresponding cylinder assembly of the aircraft engine; and a set of fuel rail coupling members, each fuel rail coupling member of the set of fuel rail coupling members being constructed and arranged to secure the corresponding cylinder assembly to the common fuel rail and to absorb at least a portion of a load generated by the corresponding cylinder assembly on the common fuel rail.

22. The fuel delivery system of claim 21, comprising a fuel injector having a first compliant member disposed at a cylinder assembly coupling end of the fuel injector and a second compliant member disposed at a fuel rail coupling end of the fuel injector, the first compliant member and the second compliant member constructed and arranged to allow motion of the corresponding cylinder assembly relative to the common fuel rail.

23. The fuel delivery system of claim 1, wherein:

each fuel rail coupling member of the set of fuel rail coupling members is constructed and arranged to secure a cylinder housing of the corresponding cylinder assembly to the common fuel rail, the cylinder housing containing a piston and connecting rod; and each compliant support of each fuel rail coupling member is configured to become compressed between the common fuel rail and a corresponding bracket of the fuel rail coupling member in response to flexure of a crankcase housing of the aircraft engine and motion of the corresponding cylinder assembly of the aircraft engine.

24. The fuel delivery system of claim 23, wherein at least one bracket of the set of fuel rail coupling members is constructed and arranged to moveably couple the common fuel rail to the corresponding cylinder assembly to provide at least one of vertical motion and longitudinal motion of the common fuel rail relative to the corresponding cylinder assembly.

* * * * *